United States Patent [19]

Krumholz

[11] 4,145,051

[45] Mar. 20, 1979

[54] RACQUET AND RETURN BALL APPARATUS

[76] Inventor: Jerrold J. Krumholz, 66 Lessing Rd., West Orange, N.J. 07052

[21] Appl. No.: 826,322

[22] Filed: Aug. 22, 1977

Related U.S. Application Data

[63] Continuation-in-part of Ser. No. 729,254, Oct. 4, 1976, abandoned.

[51] Int. Cl.[2] ..... A63B 67/10

[52] U.S. Cl. ..... 273/97 R

[58] Field of Search ..... 273/95 R, 95 A, 95 AA, 273/96 R, 97 R, 98, 58 C

[56] References Cited

U.S. PATENT DOCUMENTS

| | | | |
|---|---|---|---|
| 713,316 | 11/1902 | Lawrence | 273/97 R |
| 1,204,957 | 11/1916 | Dean | 273/98X |
| 2,848,236 | 8/1958 | Gibson | 273/97 R X |
| 3,157,400 | 11/1964 | Schmid | 273/97 R |
| 3,731,929 | 5/1973 | Landry | 273/95 A |
| 3,737,164 | 6/1973 | De Yoe | 273/98 |

*Primary Examiner*—William H. Grieb

*Attorney, Agent, or Firm*—Weingram & Klauber

[57] ABSTRACT

An improved racquet and return ball apparatus is disclosed, comprising a paddle portion including ball striking surfaces on each face thereof, and a handle secured toward one side of the paddle and including a pair of oppositely directed grasping portions, each portion extending beyond the perimeter of the paddle to enable grasping of each or both said portions by the user of the apparatus. A resilient ball is secured to one face of the paddle portion by an elastic tethering line to enable the user to displace the ball to and fro from the racquet by periodically impacting the ball on one or another of the striking surfaces. The paddle portion may be of generally rectangular configuration with the handle means being secured to the base of the generally rectangular form. The lateral sides of the paddle toward the base of the rectangle are preferably formed inwardly to define throats for restraining slippage of the tethering line, where such line crosses the lateral perimeter during impacting of the ball upon the striking face opposite to that at which the line is secured. The tethering line is preferably secured to the striking face of the paddle portion at a point lateral to the inwardly formed throats. In one embodiment of the invention, the paddle portion comprises at least a core of a foam plastic; and the entire said paddle portion may comprise such a foam.

10 Claims, 2 Drawing Figures

RACQUET AND RETURN BALL APPARATUS

BACKGROUND OF INVENTION

This application is a continuation-in-part of my copending application Ser. No. 729,254, filed Oct. 4, 1976, now abandoned and entitled "IMPROVED RACQUET AND RETURN BALL APPARATUS"

This invention relates generally to exercise and amusement apparatus, and more specifically relates to an improved racquet and return ball apparatus.

Racquet and return ball devices have been known for many years and are widely used by children and adults of all ages, as an exercise device, or as a skill testing apparatus, or more generally as an amusement or toy. Consideration of the prior art types of devices pertinent to this field will establish that they have commonly been formed (of wood or the like) as a generally oval-shaped paddle which is provided with a handle extending in the direction of the longitudinal axis of the said oval or generally elliptical shape. The mentioned directionality of the handle with respect to the paddle portion has been found, however, to limit the types of operations to which the user may place the paddle, i.e., the various "maneuvers" which may be performed with the ball which is elastically tethered to the racquet, are very limited.

SUMMARY OF INVENTION

Now, in accordance with the present invention, an improved racquet and return ball apparatus is disclosed, comprising a paddle portion including ball striking surfaces on each face thereof, and a handle secured toward one edge of the paddle, which handle includes a pair of grasping portions, which extend in generally opposed directions from the paddle portion. Each said grasping portion extends outwardly from the paddle beyond the perimeter thereof, to enable grasping of each or both portions by the user of the apparatus. Such portions may each extend along a line approximately parallel to that edge of the paddle toward which the handle is positioned; or the said portions may form a slight angle with respect to one another. In either such event, the grasping portions extend transversely to the longitudinal axis of the paddle portion.

A resilient ball is secured to one face of the paddle portion by an elastic tethering line, to enable the user of the racquet to displace the ball to and fro from the racquet by periodically impacting the ball on one or another of the striking surfaces.

The paddle portion may be of generally rectangular configuration, with the handle means being provided at the base of the generally rectangular form. The lateral sides of the paddle toward the base of the rectangle are preferably cut or formed inwardly (i.e., toward the longitudinal axis of the rectangle) to define throats for restraining slippage of the tethering line — where such line crosses the lateral perimeter of the paddle during impacting of the ball upon the striking face opposite to that at which the line is secured. The tethering line is preferably secured to the striking face of the paddle portion at a point lateral to the inwardly formed throats, to enable the line to properly engage within the throat portions.

The base of the rectangular paddle may also include an inwardly cut or formed throat, which throat performs a similar function to those provided at the lateral sides of the paddle.

In one embodiment of the invention, the paddle portion comprises at least a core of a foamed plastic; and the entire said paddle portion may comprise such a foam.

The tethering line and ball may be removably secured to the aforementioned striking surface, to enable the possibility of replacing the line and ball by other lines and balls, i.e., having different qualities of length, resiliency, ball weight, or so forth.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
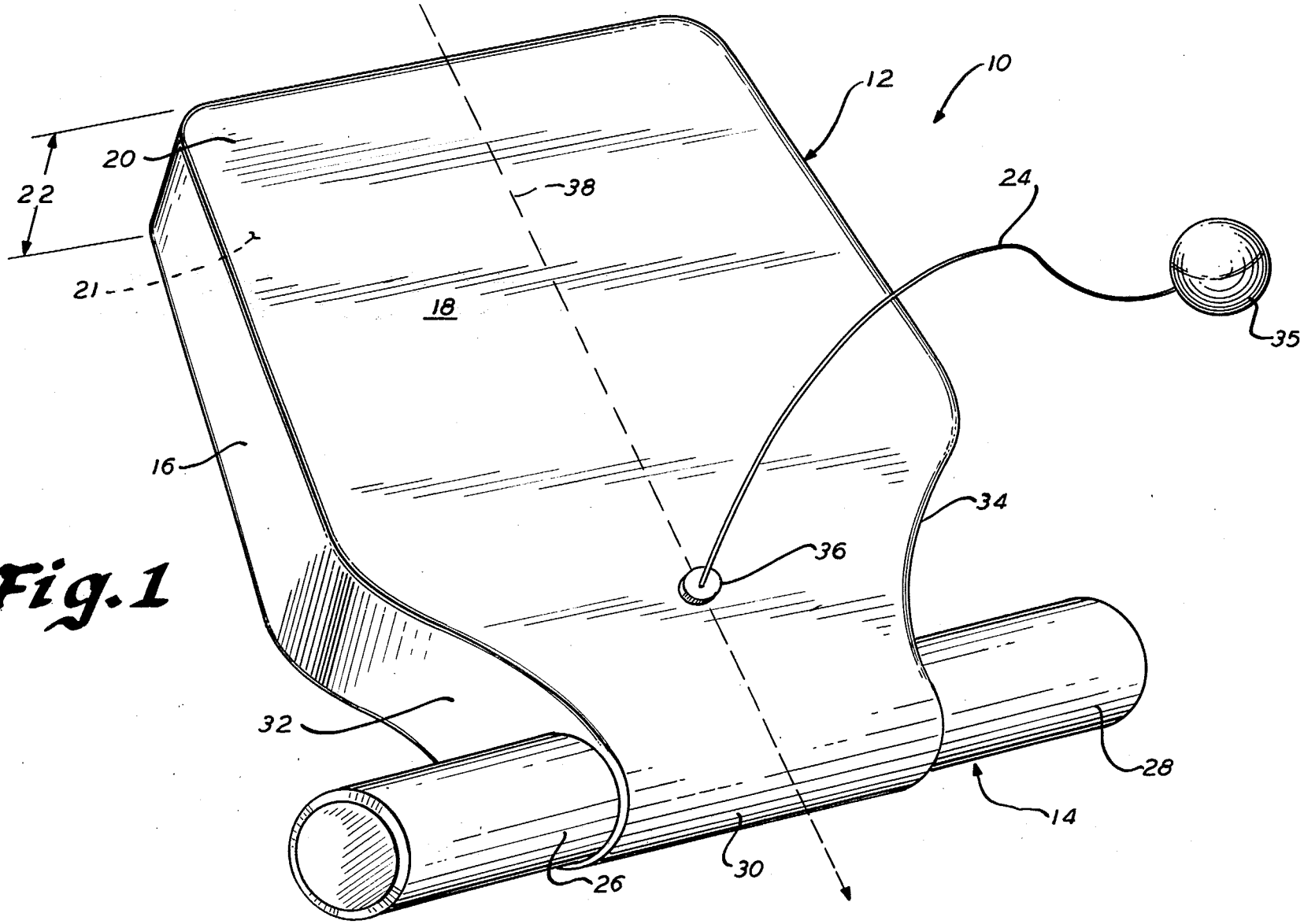
FIG. 1 is a perspective view of a first embodiment of an improved racquet and return ball apparatus in accordance with the invention.

In FIG. 1 appended hereto, an improved racquet and return ball apparatus 10 in accordance with the present invention is illustrated in perspective.

Apparatus 10 is seen to include generally a paddle portion 12 toward one side of which is secured a handle means generally designated at 14. Paddle portion 12 may comprise any of a variety of materials, including those that have been conventionally used in the past, such as wood or so forth. In one preferred form of the device 10 as shown in FIG. 1, it will be seen, however, that the paddle portion 12 is defined by an outer frame 16 which extends about at least three sides of the perimeter of the paddle, with an insert or core 18 being mounted and secured within frame 16, and preferably comprising a moldable plastic — particularly a foamed plastic such as foamed polystyrene, polyurethene or so forth. The entire device 10 can also be conveniently molded as a unit (including handle portion 14), e.g. by blow molding or by injection molding, etc. In these instances, a separate core may be utilized.

The resultant paddle portion 12 in the present instance is thus seen to comprise a generally rectangular form, although other shapes such as generally oval or so forth are also within the province of the invention.

It will be seen further that the paddle portion 12 thereby provided includes ball striking surfaces 20 and 21, i.e., on each opposed face of the said paddle. In the construction shown it will be clear that these ball striking surfaces, 20, 21 extend over the entire area presented at each face of the paddle. Where the structure includes the central core 18 and surrounding frame 16 as aforementioned, the ball striking surfaces 20, 21 may comprise throughout the aforementioned foam plastic. It should also be noted that it is equally within the province of the invention for the paddle portion 12 to comprise a unitary molding of foam plastic or the like, i.e., without separate core and frame as aforementioned.

The use of the aforementioned foam plastics or the like has certain advantages in the present environment, by virtue of ease of manufacture, coupled as well with a resultant relatively lightweight unit — which may nevertheless have substantial thickness. Thus, as indicated by the dimension 22, a substantial thickness (i.e., distance between surfaces 20 and 21) may be provided — yielding a product which is both attractive and of improved utility.

Unlike numerous prior art devices, the handle portion 14 of the present apparatus 10 includes a pair of grasping portions 26 and 28, which are seen to extend parallel to the base 30 of the generally rectangular paddle portion 12. Such grasping portions 26 and 28, extend, however, beyond the lateral perimeter of the paddle portion to enable grasping thereof by a user of the apparatus. Thus it will be evident that the said user may readily grasp the present device by either or both of the grasping portions 26 and 28, using, e.g., one hand for one portion, and the other for the opposed portion; or both handle portions 26 and 28 may be grasped simultaneously, depending upon the desired maneuver which the user wishes to utilize in operation of the device.

In a further aspect of the invention, the generally rectangular paddle portion 12 is seen to be provided with a pair of inwardly cut or formed throats 32 and 34, which throats are at the lower end of the paddle or, i.e., toward or adjacent to base 30. It will be further noted that unlike many prior devices, the resilient ball 35 which is attached to paddle portion 12 by an elastic tethering line 24, is actually secured to one face of apparatus 10 at a point 36 which overlies the longitudinal axis 38 of the device, but toward the lower or handle end, i.e., toward base 30. More specifically, the said point of attachment is preferably lateral to the aforementioned throats 32 and 34 — and typically will be within the lower one-third of the distance between base 30 and the upper end of apparatus 10.

The particular advantage of the mentioned arrangement is that during use of the present device, the user finds that the ball may be readily impacted on one or the other striking faces; but in particular, when impacting on the face 21 opposite that seen in the Figure, the tethering line 24 may readily pass about the lateral border of paddle portion 12 within the throat regions 32 and 34, and be restrained by the said throats from undue sideway slippage.

In the embodiment of the present device, shown in FIG. 1, it will also be seen that the base 30 of the paddle portion is convex in form, i.e., of semi-cylindrical shape, the surface thereof actually extending somewhat beyond the lateral surfaces of handle portions 26 and 28. This shape provides a further advantage during use of the present device, in that the tethering line 24 may also readily pass about the said base 30 during impacting of the ball on the face 21, i.e., on the face opposite that to which the line is tethered.

The line 24 may be secured at the point 36 by any convenient fastening means, including by a frictionally engaged peg or the like. It may be noted that in a preferable embodiment of the device, frictional engagement or the like by removable pegs or so forth is indeed desirable, in order that the tethering line 24 and ball 35 may, if desired, be replaced by other balls and tethering lines having differing qualities, e.g., with respect to elasticity, length, ball weight or so forth, to enable the user to perform differing maneuvers or exercises.

Figure 2:
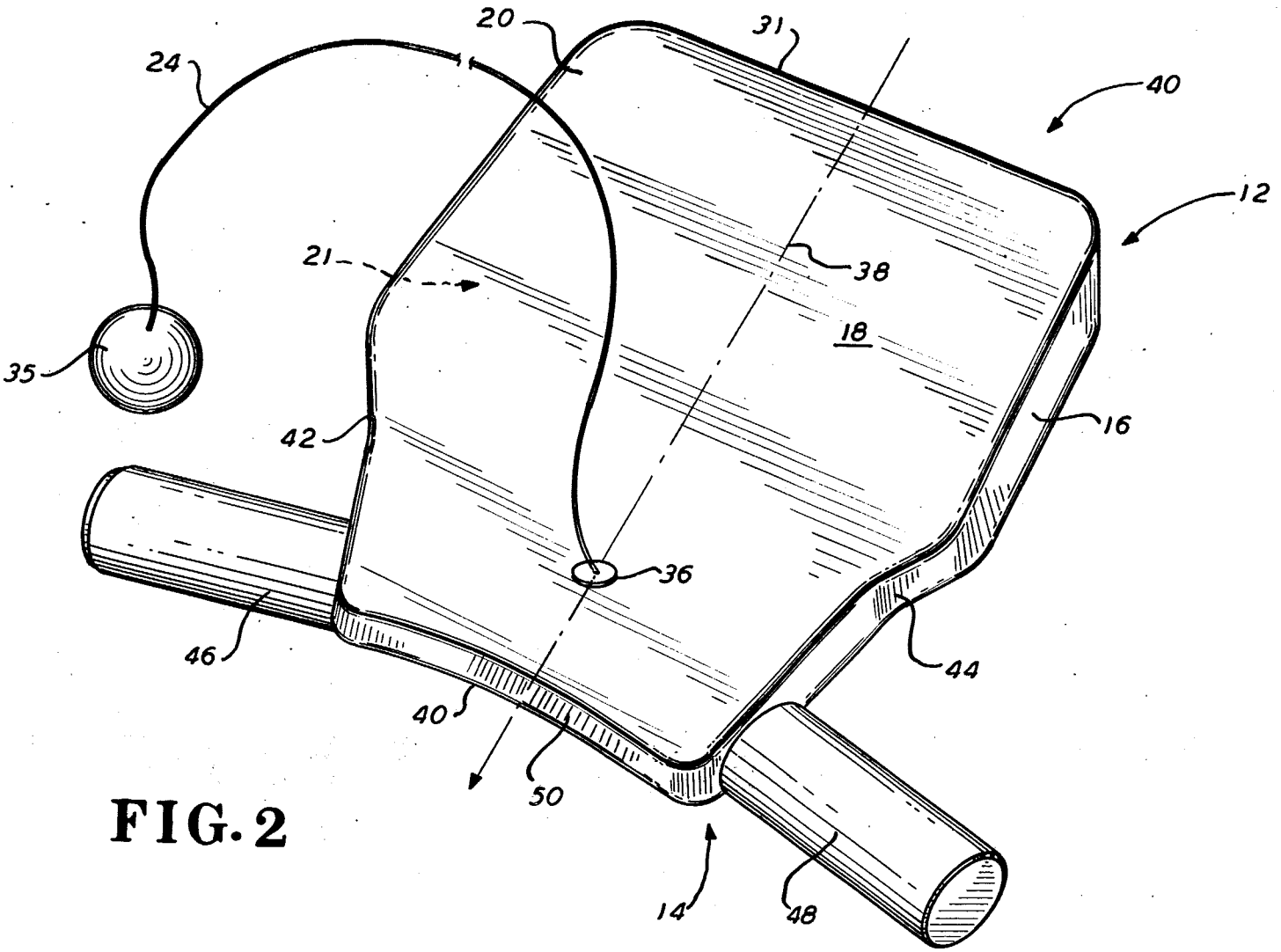
FIG. 2 is a perspective view of a second embodiment of apparatus in accordance with the invention.

In FIG. 2 herein, a second embodiment of apparatus 40 in accordance with the invention appears. Apparatus 40 is generally similar to apparatus 10, and corresponding portions of each device are identified by the same reference numerals.

Referring, however, to the lower end of apparatus 10, it will be seen that handle means 14 includes grasping portions 46 and 48, which while still extending in generally opposed directions from paddle portion 12, are actually slightly inclined with respect to one another — i.e., the axes of portions 46 and 48 are symmetrically angled toward the apparatus axis 38, whereby such axes actually intersect at an obtuse angle slightly less than 180°. In comparing the devices of FIGS. 1 and 2 however, it will be seen that in either event grasping portions 26 and 28 or 46 and 48 extend outwardly beyond the lateral perimeter of paddle portion 12, and are in each instance oriented transversely with respect to the longitudinal axis 38 of the apparatus.

The inwardly formed throats 42 and 44 in FIG. 2 are seen to have a slightly less pronounced curvature than throats 32 and 34 in FIG. 1. The FIG. 2 device additionally is seen to now include a further inwardly formed throat 50 at base 40. Such further throat serves a function similar to that discussed in connection with throats 32 and 34, i.e., it restrains sidewise slippage of the tethering line 24 during the periods when line 24 is passed about the base of apparatus 40.

While the present invention has been particularly set forth in terms of specific embodiments thereof, it will be understood in view of the instant disclosure, that numerous variations upon the invention are now enabled to those skilled in the art, which variations yet reside within the scope of the instant teaching. Accordingly, the invention is to be broadly construed, and limited only by the scope and spirit of the claims now appended hereto.

I claim:

1. An improved racquet and return ball apparatus comprising in combination:

a paddle portion including ball striking surfaces on each face thereof;

a handle means secured toward one side of said paddle portion, and including a pair of grasping portions extending in generally opposed directions, each said grasping portion extending transversely to the longitudinal axis of said paddle portion, and beyond the perimeter of said paddle to enable grasping of each or both said portions by the user of said apparatus; and a resilient ball being secured to one face of said paddle portion by an elastic tethering line, to enable the user of said racquet to displace said ball to and fro from said racquet by periodically impacting said ball on one or another of said striking surfaces.

2. Apparatus in accordance with claim 1, wherein said paddle portion is of generally rectangular configuration, and said handle means is secured toward the base of said generally rectangular configuration.

3. Apparatus in accordance with claim 2, wherein the lateral sides of said paddle portion toward said base of said rectangle are formed inwardly to define throats for restraining lateral slippage of said tethering line when said line crosses the lateral perimeter of said paddle portion during impacting of said ball upon the striking face opposite to that at which said line is secured.

4. Apparatus in accordance with claim 3, wherein said tethering line is secured to the said striking face of said paddle portion at a point lateral to said inwardly formed throats.

5. Apparatus in accordance with claim 2, wherein at least said paddle portion comprises at least a core of a foamed plastic.

6. Apparatus in accordance with claim 5, wherein said ball striking surfaces comprise said foamed plastic.

7. Apparatus in accordance with claim 4, wherein said tethering line is removably secured to the said striking face to enable replacement by lines and balls of different characteristics.

8. Apparatus in accordance with claim 1, wherein said grasping portions are oriented along a common line.

9. Apparatus in accordance with claim 1, wherein said grasping portions are symmetrically angled toward the longitudinal axis of said apparatus.

10. Apparatus in accordance with claim 3, wherein the side of said paddle portion defining said rectangle base is formed inwardly to define a further throat for restraining lateral slippage of said tethering line when said line crosses the base perimeter of said paddle portion during impacting of said ball upon the striking face opposite to that at which said line is secured.

* * * * *